United States Patent [19]

Little

[11] 4,297,548

[45] Oct. 27, 1981

[54] VITAL INCIDENTAL MOVEMENT MONITORING ARRANGEMENT

[75] Inventor: Donald R. Little, Greensburg, Pa.

[73] Assignee: American Standard Inc., Swissvale, Pa.

[21] Appl. No.: 105,354

[22] Filed: Dec. 19, 1979

[51] Int. Cl.[3] ..... H01H 35/00

[52] U.S. Cl. ..... 200/61.08; 200/61.4

[58] Field of Search ..... 200/61.08, 61.39, 61.4, 200/61.41

[56] References Cited

U.S. PATENT DOCUMENTS

| | | | |
|---|---|---|---|
| 3,108,264 | 10/1963 | Heinoo | 200/61.4 X |
| 3,538,272 | 11/1970 | Sibley | 200/61.41 |
| 3,882,448 | 5/1975 | Shibatani et al. | 200/61.4 X |
| 3,902,157 | 8/1975 | Kita et al. | 200/61.4 X |
| 3,936,621 | 2/1976 | Palin et al. | 200/61.08 |

*Primary Examiner*—James R. Scott
*Attorney, Agent, or Firm*—J. B. Sotak

[57] ABSTRACT

A vital incidental relative movement monitor assembly including a support member and a carrier ring member which is screw-threaded into the support member. The carrier ring member includes an apertured annular flange which is concentric with an apertured annular flange formed on the support member. An indexing wire is threaded through the apertured annular flanges for retaining a carrier ring member relative to the support member, and an electrical monitoring conductor also threaded through the apertured annular flanges for disrupting an electrical circuit when incidental relative movement occurs between the carrier ring member and the support member.

10 Claims, 2 Drawing Figures

VITAL INCIDENTAL MOVEMENT MONITORING ARRANGEMENT

FIELD OF THE INVENTION

The invention relates to a vital incidental relative movement detector and, more particularly, to a rotational displacement monitoring arrangement having a supporting base plate welded to the housing of a speed measuring device and a sensor carrier ring screw-threaded into the supporting base plate and indexed in a selected position and an electrical conductor passing through aligned apertures formed in the supporting base plate and sensor carrier ring for disrupting an electrical circuit path when incidental rotational displacement occurs between the supporting base plate and sensor carrier ring.

BACKGROUND OF THE INVENTION

In certain vital systems, such as, in automatic vehicle speed control systems for railroad and mass and/or rapid transit operations, it is essential to accurately sense the actual speed of the moving train or vehicles. It is common practice in measuring the velocity or speed of trains and transit vehicles to employ a generating device which is suitably associated with the rotation of the bull or drive gear which is directly connected to the axle of a vehicle for producing discrete signals in response to the movement thereof. While it is apparent that the signal generating device may take the form of any suitable type, it has been found that the electromagnetic type of signal generator is prevalent in the industry. In practice, the electromagnetic pickup device includes a permanent magnet and coil arrangement which is influenced by the teeth of the ferromagnetic gear or toothed wheel. The magnetic core of the pickup coil includes a pole piece which is spaced a given distance from the face of the teeth of the gear. The toothed gear is mounted directly onto the axle of the vehicle so that vehicular movement causes rotation of the wheels which, in turn, moves the gear teeth in relation to the inductive pickup coil. It will be appreciated that rotational movement of the gear-toothed gear causes alternating current voltage signals to be induced in the pickup coil. Further, it will be appreciated that the frequency of the alternating current signals is proportional to the angular rotation of the tooth wheel which, in turn, is proportional to the speed of the moving vehicle. It is readily obvious that when the train or vehicle is not moving or stationary, the rotation of the toothed gear should also cease so that no alternating current signals will be developed in the inductive pickup coil. Thus, the alternating current voltage signals induced in the pickup coil may be interpreted as an input signal which is only present when the vehicle is moving along its route of travel. Thus, it is common practice to employ the absence of the alternating current signals as an indication that the train is stopped at a station so that the doors may be safely opened to permit the egress and ingress of the passengers. Thus, it is necessary to provide that the electromagnetic speed sensing device is both electrically stable and mechanically sound in order to meet the criteria of fail-safe operation.

OBJECTS OF THE INVENTION

Accordingly, it is an object of this invention to provide a new and improved vital incidental relative movement monitoring arrangement.

Another object of this invention is to provide a unique vital rotational movement detector for monitoring the position of one member relative to another member.

A further object of this invention is to provide an electrical displacement detector for interrupting an electrical circuit when one member is displaced relative to another member.

Still another object of this invention is to provide a novel vital incidental relative movement detector for disrupting an electrical circuit path when movement occurs between two movable elements.

Still a further object of this invention is to provide a vital integrity monitor for checking incidental relative movement between two threaded elements.

Yet a further object of this invention is to provide a vital movement monitor comprising, a support member attached to a housing of a speed measuring device, a carrier member including a sensor adjustably joined to the support member, and an electrical conductor passing through apertures formed in the support and carrier members, the electrical conductor forming part of an electrical circuit which is disrupted when incidental relative movement occurs between the support and carrier members.

Yet another object of this invention is to provide a novel vital incidental movement monitor which is economical in cost, unique in design, efficient in operation, dependable in service, durable in use, and simple in construction.

SUMMARY OF THE INVENTION

In accordance with the present invention, there is provided a vital movement monitoring arrangement having a metallic support member welded to the housing of a speed measuring device which includes an axle driven toothed wheel. A metallic carrier ring member having a magnetic sensor unit is fixedly secured thereto. The metallic support member includes a threaded opening for accommodating the external threads of the metallic carrier ring member. The carrier ring member is screw-threaded into the support member a given amount to establish a preselected air gap between a pole piece of the magnetic sensor unit and the ends of the tooth wheel of the speed measuring device. The carrier ring member includes an upstanding annular flange which is concentric with an upstanding annular flange formed on the support member. Each of the upstanding annular flanges includes a plurality of apertures for accommodating an indexing wire and an electrical monitoring conductor which interrupts an electrical power circuit when incidental relative movement occurs between the carrier ring member and the support member.

DESCRIPTION OF THE DRAWINGS

The foregoing objects and other attendant features and advantages of this invention will become more readily apparent from the following detailed description when considered in connection with the accompanying drawings, wherein.

DETAILED DESCRIPTION OF THE INVENTION

Figure 1:
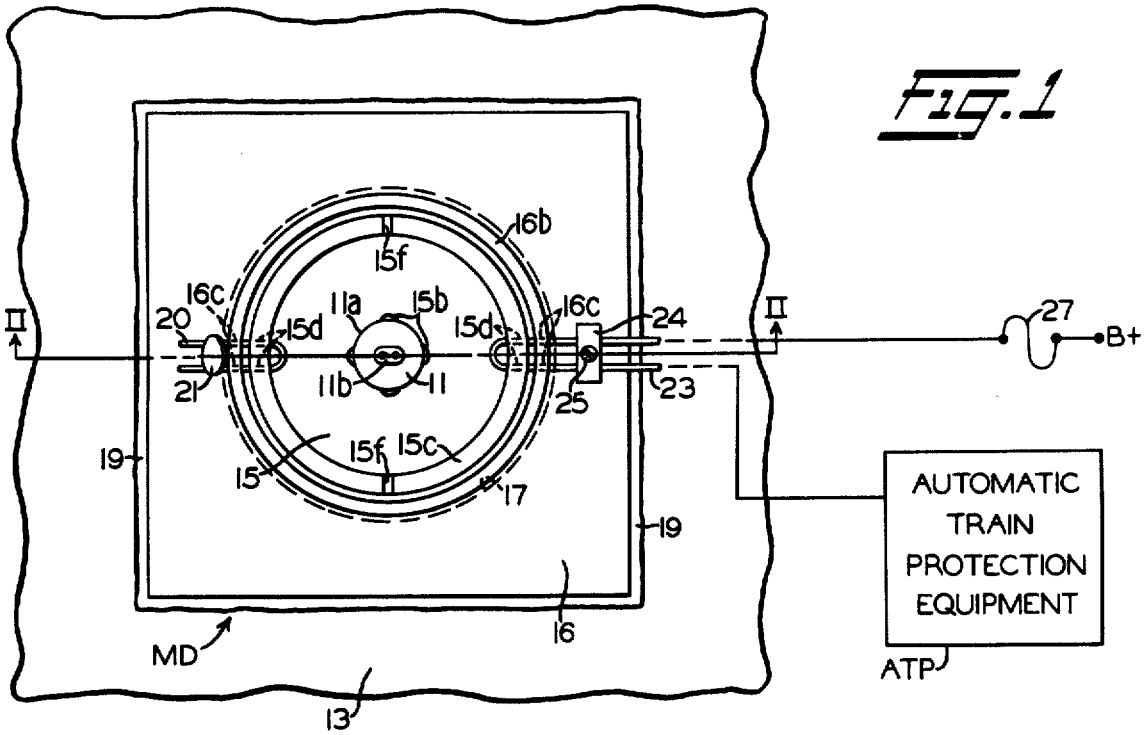
FIG. 1 is a top plan view, partly in schematic form, of a vital incidental relative movement monitoring arrangement in combination with a magnetic speed sensing assembly of the present invention.

Referring to the drawings and in particular to FIG. 1, there is shown a vital movement monitor or detector assembly MD which may be employed in combination with a vehicle velocity or speed sensor. In practice, the speed sensor includes a rotationally movable ferromagnetic toothed wheel or gear 10 and an associated stationary magnetic pickup device 11. The angularly movable toothed wheel 10 is located within gear casing or housing 13 which is mounted on the frame of the vehicle. The rotary gear 10 is directly coupled to the axle of the vehicle and is provided with a plurality of generally uniformly circumferentially distributed axially extending teeth 10*a*. As shown, the fixed magnetic pickup unit 11 includes a metallic cylinder or can 11*a* for shielding the pickup coil. An electrical conductor or two wire lead 11*b* extends from one end of can 11*a* for connecting the internal pickup coil to a suitable indicating means, such as, a speedometer or the like. A pole piece or shoe 11*a* extends from the other end of can 11*a* for cooperating with the teeth 10*a* of gear 10. The pickup unit is carried by a metallic ring member 15. Namely, cylindrical can 11*a* is fitted into a central hole 15*a* formed in the carrier member 15 and is spot welded or silver soldered at select points 15*b* around the upper periphery. It will be seen that the aperture 15*a* of carrier 15 includes external threads 15*e* for screwing into matching female threads formed in a metallic support plate or boss member 16. The support plate 16 may take the form of a square-like body which is disposed on the top of the housing 13. In practice, the top of the housing is provided with a circular hole or opening 17. As mentioned above, the support member 16 includes a centrally located threaded hole 16*a* which is concentrically disposed over aperture 17. The metallic support member 16 is suitably fixed or securely attached to the upper outside surface of metallic housing 13 by a fillet weld 19 which is laid along the circumference edge of the square body. As shown, the top of carrier member 15 is provided with an upstanding annular flange 15*c* while the top of the support member 16 is provided with an upstanding annular flange 16 which is concentric with flange 15*c*. It will be noted that the outer flange 16*b* is provided with a plurality of through holes 16*c* while the inner flange 15*c* includes a plurality of through holes 15*d*. It will be seen that the left-hand holes 15*d* and 16*c* accommodate a retaining safety wire 20. That is, the safety wire 20 passes through aligned apertures 15*d* and 16*c*, and the free ends of the wire are secured by a lead seal 21 or the like. The purpose of the retaining wire 20 is to mechanically latch or hold the two relatively rotatable members 15 and 16 in the desired position as will be described hereinafter. Further, it will be noted that a frangible insulative covered electrical conductor or monitoring lead 23 is threaded through the right-hand aligned apertures 15*d* and 16*c*. A metallic hold-down bracket 24 is secured to the top of support member 16 by a screw 25 for holding the wire 23 in place.

As schematically shown in FIG. 1, the one end of electrical conductor 22 is connected through a fuse element 27 to the positive terminal B+ of a suitable power supply source (not shown) while the other end of lead 23 is connected to the positive voltage supply terminal of automatic train protection equipment ATP. Thus, the automatic train protection equipment will function properly when the necessary positive voltage is supplied over monitoring lead 23 to allow normal operation of the cab signal equipment on board the train or lead vehicle. It will be noted that a pair of diametrically opposed slots 15*f* are cut or formed in the top of the annular flange 15, the purpose of which will be described hereinafter.

Figure 2:
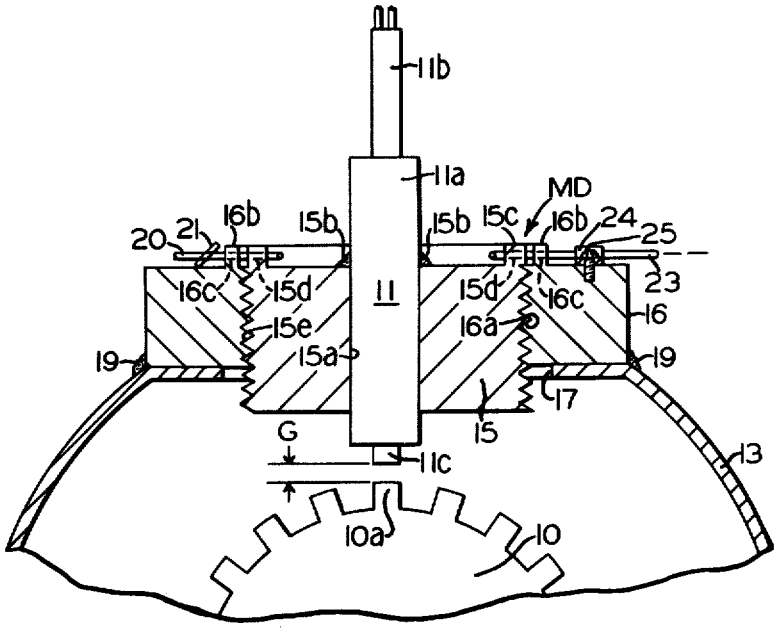
FIG. 2 is a section view taken generally along line II—II of FIG. 1.

Let us initially assume that neither wire 20 nor conductor 23 is in place and that the carrier member 15 is screw threaded into the support member 16. The carrier member 15 is rotated or turned relative to base 16 by placing a spanner wrench into slots 15*f*. The threaded member 15 is screwed into base 16 until an appropriate preselected air gap G (FIG. 2) exists between the opposing faces of pole piece 11*c* and tooth 11*a*. The specific distance between the pole piece and the teeth of gear 10 should be closely maintained since the amplitude of the a.c. pulses induced into the magnetic pickup coil is dependent upon the air gap G. Thus, the air gap G should be monitored to detect any deviation since a false or zero speed indication could result in an unsafe operation of the train. For example, the doors of a mass transit vehicle could be accidentally opened while en route if a false zero speed occurs due to the turning in or turning out of the ring carrier 15. After the carrier 15 is screwed into the support 16 to exstablish the proper air gap G, a retaining or indexing means, such as, wire 20, is fished through the align holes 16*c* and 15*b* and returned through holes 15*b* and 16*c*, and then the seal 21 is pressed onto the free ends of the wire 20. Next, the power supply conductor 23 is fished through holes 16*c* and 15*d* and returned through holes 15*d* and 16*c*. The one end of lead 23 is then connected to the positive voltage terminal B+ via fuse 23 while the other end of the insulated lead 27 is connected to the input supply terminal of the automatic train protection equipment ATP. It will be appreciated that the automatic train protection ATP will remain operational so long as the monitoring supply lead 23 remains intact and furnishes the necessary operating power. However, vibrations and other underlying shortcomings may cause the carrier member 15 to rotate relative to the threaded support 16 so that a change in the air gap G occurs which may cause a decrease in the output signal or may result in no output at all. If, for example, the safety wire 20 breaks or is inadvertently omitted, the conductive wire 23 may not be strong enough to prevent rotational movement of the two threaded members. Thus, if the carrier member 15 is sufficiently displaced, namely, rotated relative to support member 16, the monitoring lead 23 will shear or break so that electrical power to the automatic train protection equipment ATP will be interrupted thereby alerting the trainman or operator of ensuing danger. The shearing of the lead 23 either causes the fuse to blow, if a ground condition exists, or simply interrupts the power supply circuit to the equipment ATP so that the trainman must run under restricted manual operation. Thus, the speed sensing device is constantly monitored and a change in the air gap G is readily detected to deactivate or shut down the automatic train protection equipment ATP to provide for safer operation of the train or mass transit and/or rapid transit vehicles.

It will be appreciated that various changes and modifications may be made to the subject monitoring or detecting device MD without departing from the spirit and scope of the subject invention. Other appropriate mechanical indexing and retaining devices may also be suitably employed in place of the wire. For example, the safety wire 20 may be replaced by a retaining rod or a threaded bolt and lock nut which may cooperate with a pair of aligned holes formed in flanges 15*c* and 16*b*. Further, it is understood that the flanges 15*c* and 16*b* may be predrilled at the factory with a plurality of through holes 15*d* and 16*c* which may be aligned in the field or may be drilled in the field for accommodating the wire 20 and conductor 23. In addition, the annular flanges may be replaced with a plurality of upstanding apertured standoffs or the like which are circularly disposed or secured to the tops of the carrier and support members. Additionally, the screw threads may be supplanted by a bayonet base type of interlocking connection or by other interfitting arrangements. Likewise, the monitoring lead 23 may be employed to normally energize a relay or the like which will activate an alarm to alert operating personnel when breakage occurs. Furthermore, the support member 16 may be bolted to the outside of the gear casing 13 rather than being welded thereto. Likewise, a monitoring arrangement may be used with a speed sensing device which is mounted to the end of the axle as a separate unit. Further, it will be apparent that other changes and modifications can be made to the presently described invention and, therefore, it is understood that all alternations, ramifications, and equivalents within the spirit and scope of this invention are herein meant to be covered by the appended claims.

Having thus described the invention, what I claim as new and desired to secure by Letters Patent, is:

1. A vital movement monitor comprising, a support member attached to a housing of a speed measuring device, a carrier member including a sensor adjustably joined to said support member, and an electrical conductor passing through apertures formed in said support and carrier members, said electrical conductor forming part of an electrical circuit which is disrupted when incidental relative rotational movement occurs between said support and carrier members.

2. The vital movement monitor as defined in claim 1, wherein said carrier member is screw-threaded into said support member.

3. The vital movement monitor as defined in claim 1, wherein said support and carrier members include upstanding annular flanges which have alignable apertures for accommodating said electrical conductor.

4. The vital movement monitor as defined in claim 1, wherein said electrical conductor is sheared to interrupt the electrical circuit when incidental relative rotational movement occurs between said support and carrier members.

5. The vital movement monitor as defined in claim 1, wherein said support and carrier members are constructed of metal.

6. The vital movement monitor as defined in claim 1, wherein said carrier member includes a circular threaded hole for receiving said carrier member which has matching external threads.

7. The vital movement monitor as defined in claim 1, wherein the integrity of said electrical conductor signifies that the sensor is properly positioned in relation to an associated magnetic gear wheel.

8. The vital movement monitor as defined in claim 1, wherein said support member is welded to the housing of the speed measuring device.

9. The vital movement monitor as defined in claim 3, wherein said upstanding annular flange of said support member is concentric with the upstanding annular flange of said carrier member.

10. The vital movement monitor as defined in claim 1, wherein the sensor is fixedly secured to said carrier member which is an apertured ring.

* * * * *